US010247181B2

(12) United States Patent
Usui et al.

(10) Patent No.: US 10,247,181 B2
(45) Date of Patent: Apr. 2, 2019

(54) HIGH-PRESSURE FUEL PUMP

(71) Applicant: Hitachi, Ltd., Chiyoda-ku, Tokyo (JP)

(72) Inventors: Satoshi Usui, Hitachinaka (JP); Hiroyuki Yamada, Hitachinaka (JP); Kenichiro Tokuo, Hitachinaka (JP); Toru Onose, Ibaraki (JP); Masami Abe, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/041,874

(22) Filed: Feb. 11, 2016

(65) Prior Publication Data

US 2016/0160825 A1 Jun. 9, 2016

Related U.S. Application Data

(60) Division of application No. 13/926,222, filed on Jun. 25, 2013, now Pat. No. 9,291,162, which is a (Continued)

(30) Foreign Application Priority Data

Nov. 16, 2005 (JP) ..... 2005-331036

(51) Int. Cl.
*F04B 7/02* (2006.01)
*F02M 59/36* (2006.01)

(Continued)

(52) U.S. Cl.
CPC ..... *F04B 49/03* (2013.01); *F02M 63/005* (2013.01); *F04B 7/02* (2013.01); *F04B 49/08* (2013.01);

(Continued)

(58) Field of Classification Search
CPC .... F04B 7/02; F04B 53/1002; F04B 53/1007; F04B 11/00; F04B 11/0033;

(Continued)

(56) References Cited

U.S. PATENT DOCUMENTS 1,260,663 A 3/1918 Gould
2,658,518 A 11/1953 Harland et al.

(Continued)

FOREIGN PATENT DOCUMENTS

EP 1 411 238 A1 4/2004
EP 1411238 A1 * 4/2004 ..... F02M 55/04

(Continued)

OTHER PUBLICATIONS

Machine Translation of EP 1411238.*

(Continued)

*Primary Examiner* — Alexander B Comley
(74) *Attorney, Agent, or Firm* — Crowell & Moring LLP

(57) ABSTRACT

A high-pressure fuel pump includes a pressurizing chamber for pressurizing fuel, an outlet valve for discharging the fuel pressurized in the pressurizing chamber to an outlet passage, a relief passage for connecting the outlet passage located downstream of the outlet valve and the pressurizing chamber with each other while bypassing the outlet valve. A relief valve device is provided in the relief passage and adapted to open when an internal pressure of the outlet passage becomes higher than that of the pressurizing chamber, thereby providing communication between the outlet passage and the pressurizing chamber. The relief valve includes a relief spring mechanism for pressing a relief valve to a relief valve seat. At least the relief spring mechanism among members of the relief valve device is provided outside the pressurizing chamber in the pump body.

15 Claims, 7 Drawing Sheets

Related U.S. Application Data continuation of application No. 11/599,468, filed on Nov. 15, 2006, now abandoned.

(51) Int. Cl.

| | |
|---|---|
| ***F02M 59/46*** | (2006.01) |
| ***F02M 63/00*** | (2006.01) |
| ***F04B 19/22*** | (2006.01) |
| ***F04B 49/03*** | (2006.01) |
| ***F04B 49/08*** | (2006.01) |
| ***F04B 53/10*** | (2006.01) |
| ***F04B 53/14*** | (2006.01) |
| ***F04B 53/16*** | (2006.01) |
| ***F04B 49/035*** | (2006.01) |
| *F02M 59/02* | (2006.01) |
| *F02M 59/10* | (2006.01) |
| *F04B 17/05* | (2006.01) |

(52) U.S. Cl.

CPC ..... *F04B 53/10* (2013.01); *F04B 53/1002* (2013.01); *F04B 53/1087* (2013.01); *F04B 53/16* (2013.01); *F02M 59/025* (2013.01); *F02M 59/102* (2013.01); *F02M 59/366* (2013.01); *F02M 59/367* (2013.01); *F02M 59/462* (2013.01); *F04B 17/05* (2013.01); *F04B 19/22* (2013.01); *F04B 49/035* (2013.01); *F04B 53/1017* (2013.01); *F04B 53/14* (2013.01)

(58) Field of Classification Search

CPC ..... F04B 11/0008; F04B 11/0016; F04B 11/0025; F04B 49/03; F04B 49/08; F04B 49/035; F04B 53/1017; F04B 53/1087; F04B 53/06; F16K 15/063; F02M 63/0005; F02M 59/34–59/36

USPC ..... 137/540–543, 539.5, 535; 417/304, 307, 417/308–311, 364, 415, 440, 454, 559, 417/563, 567; 123/456, 457, 459, 465

See application file for complete search history.

(56) References Cited

U.S. PATENT DOCUMENTS

| | | | | |
|---|---|---|---|---|
| 3,008,485 | A | 11/1961 | Johnson et al. | |
| 3,495,544 | A | 2/1970 | Enssle | |
| 3,749,122 | A | 7/1973 | Gold | |
| 3,800,824 | A | 4/1974 | Medina | |
| 4,129,144 | A | 12/1978 | Andersson et al. | |
| 4,157,281 | A | 6/1979 | Burkhardt et al. | |
| 4,276,901 | A | 7/1981 | Lyons | |
| 4,574,836 | A | 3/1986 | Barnard, Jr. | |
| 4,765,364 | A | 8/1988 | Arcari | |
| 4,938,254 | A | 7/1990 | Gimby | |
| 5,026,258 | A | 6/1991 | Mosley | |
| 5,137,050 | A | 8/1992 | Clarke et al. | |
| 5,715,798 | A | 2/1998 | Bacon et al. | |
| 5,971,016 | A | 10/1999 | Wass et al. | |
| 6,102,010 | A * | 8/2000 | Isozumi | F02M 63/0225 123/446 |
| 6,164,322 | A | 12/2000 | Najmolhoda et al. | |
| 6,209,527 | B1 * | 4/2001 | Bueser | F16K 17/06 123/506 |
| 6,447,273 | B1 | 9/2002 | Nishimura et al. | |
| 6,491,025 | B2 | 12/2002 | Ferry et al. | |
| 6,554,590 | B2 | 4/2003 | Maeda et al. | |
| 6,631,706 | B1 | 10/2003 | Yamada et al. | |
| 6,651,630 | B2 | 11/2003 | Hiraku et al. | |
| 6,817,340 | B2 | 11/2004 | Onishi et al. | |
| 6,877,525 | B2 * | 4/2005 | Fischer | F16K 1/12 137/538 |
| 6,923,202 | B2 | 8/2005 | Enerson | |
| 7,066,201 | B2 | 6/2006 | Chen et al. | |
| 7,152,583 | B2 | 12/2006 | Abe et al. | |
| 7,290,559 | B2 * | 11/2007 | Nieslony | F02M 59/464 137/454.4 |
| 2001/0048091 | A1 | 12/2001 | Enomoto et al. | |
| 2003/0219346 | A1 | 11/2003 | Abe et al. | |
| 2004/0047746 | A1 | 3/2004 | Rembold | |
| 2005/0076955 | A1 | 4/2005 | Boehland et al. | |
| 2005/0139267 | A1 | 6/2005 | Chen et al. | |
| 2006/0222538 | A1 * | 10/2006 | Inoue | F02M 59/447 417/470 |
| 2007/0110603 | A1 | 5/2007 | Usui et al. | |

FOREIGN PATENT DOCUMENTS

| | | |
|---|---|---|
| EP | 1 707 799 A1 | 10/2006 |
| JP | 08-296528 | 11/1996 |
| JP | 2003-343384 | 12/2003 |
| JP | 2003-343395 | 12/2003 |
| JP | 2004-138062 | 5/2004 |
| JP | 2004-360675 | 12/2004 |
| JP | 2005-532501 | 10/2005 |
| WO | WO 01/44649 A1 | 6/2001 |

OTHER PUBLICATIONS

Extended European Search Report dated Feb. 12, 2007 (seven (7) pages).

Japanese Office Action dated Aug. 9, 2009 and translation thereof (4 pages).

* cited by examiner

HIGH-PRESSURE FUEL PUMP

CROSS REFERENCE TO RELATED APPLICATIONS

The present application is a divisional of U.S. patent application Ser. No. 13/926,222, filed Jun. 25, 2013, which is a continuation of U.S. patent application Ser. No. 11/599,468, filed Nov. 15, 2006, and claims priority under 35 U.S.C. § 119 to Japanese Patent Application No. 2005-331036, filed on Nov. 16, 2005, the entire disclosures of which aforementioned documents are herein expressly incorporated by reference.

FIELD OF THE INVENTION

The present invention relates to a high-pressure fuel pump for feeding high-pressure fuel to a fuel injection valve in an internal combustion engine.

The present invention is particularly concerned with a high-pressure fuel pump having a relief valve device installed into a pump body, the relief valve device serving as a safety device for returning fuel to a pressurizing chamber when the pressure of discharged fuel becomes abnormally high.

BACKGROUND ART

In Japanese Patent Laid-Open Publication No. 2004-138062 there is described a high-pressure fuel pump having a relief valve device, the relief valve device comprising a valve seat member having a central fuel passage and a seat surface formed around the central fuel passage, a valve element serving as a relief valve for being placed against the seat surface, and a spring member for pushing the valve element against the seat surface, the relief valve device being mounted to a body of the pump in such a manner that the spring member is positioned on the pressurizing chamber side.

However, in the above prior art, since the relief valve device is installed within the pressurizing chamber or within a passage leading to the pressurizing chamber, the volume of the pressurizing chamber substantially becomes large and the compression efficiency becomes lower.

More particularly, it suffices for the volume of the pressurizing chamber to be about 1 to 2 CC, but since the relief valve device is installed, the volume of the pressurizing chamber or the sum of the volume of the pressurizing chamber and that of the relief valve installed portion becomes 6 to 7 CC. Consequently, assuming that the stroke of a plunger piston (hereinafter referred to simply as "plunger") within the pressurizing chamber is the same, the compression efficiency becomes lower.

SUMMARY OF THE INVENTION

It is an object of the present invention to provide a high-pressure fuel pump which, even if a body of the pump is provided with a relief valve device for returning fuel abnormally high in pressure from an outlet passage to a pressurizing chamber, is high in compression efficiency, i.e., high in energy efficiency, without increasing the volume of a compression chamber.

The above object of the present invention can be achieved by constructing the relief valve device so that only the relief valve as a valve element can be installed on the pressurizing chamber side and the spring mechanism can be installed on the outlet passage side of the pump.

DETAILED DESCRIPTION OF THE PREFERRED EMBODIMENTS

A first embodiment of the present invention will be described hereinafter with reference to FIGS. 1 to 5.

First Embodiment

Figure 4:
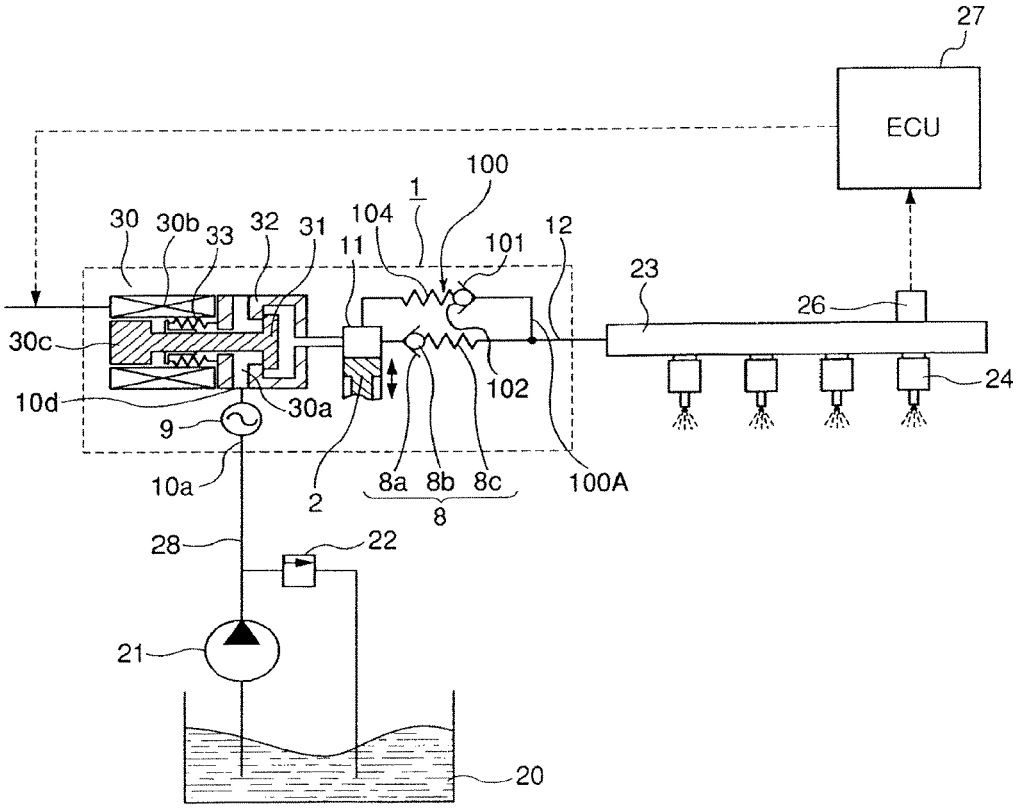
FIG. 4 shows an example of a fuel supply system using the high pressure fuel supply system of the first embodiment.

The construction and operation of a fuel feeding system related to this embodiment will be described below with reference to FIG. 4. FIG. 4 is a general outline view of the system.

The portion enclosed with a broken line represents a pump body 1 of a high-pressure fuel pump. An arrangement and parts inside the enclosing broken line are integrally installed in the pump body 1.

Fuel in a fuel tank 20 is pumped up by a feed pump 21 and is fed to an inlet joint 10*a* in the pump body 1 through a suction pipe 28. At this time, the pressure of the fuel to be fed to the pump body 1 is regulated to a constant pressure by a pressure regulator 22.

The fuel having passed through the inlet joint 10*a* then passes through a pressure pulsation damping device 9 and an inlet passage 10*d*, and the fuel reaches pre-inlet port 30*a* of a solenoid-controlled inlet valve 30. The inlet valve 30 constitutes a capacity variable mechanism for the high-pressure fuel pump. As to the pressure pulsation dumping device 9, a detailed description will be given later.

The solenoid-controlled inlet valve 30 includes a solenoid 30*b*. In an energized state of the solenoid 30*b*, a plunger 30*c* attracted rightward in FIG. 1 and in this state a spring 33 is maintained in a compressed state. In this state, an inlet valve head 31 at one end of the plunger 30*c* opens an inlet port 32 communicating to a pressurizing chamber 11 in the high-pressure fuel pump. The pressurizing chamber 11 is formed by a cup-shaped recess formed in the pump body 1.

When the solenoid 30*b* is not energized and when there is no difference in fluid pressure between the inlet passage 10*d* (pre-inlet port 30*a*) and the pressurizing chamber 11, the inlet valve head 31 is exerted in its closing direction with the pressing force of a spring 33 to close the inlet port 32.

More specifically, the following operations are performed.

When a plunger 2 moves downward in FIG. 1 with rotation of a cam to be described later and the pump is in its suction stroke, the volume of the pressurizing chamber 11 increases and the internal fuel pressure of the same chamber decreases. In this suction stroke, when the internal fuel pressure of the pressurizing chamber becomes lower than that of the inlet passage 10*d* (pre-inlet port 30*a*), a valve opening force (a force which induces a rightward movement in FIG. 1 of the inlet valve head 31) based on a fluid pressure difference of fuel is given to the inlet valve head 31.

The inlet valve head 31 is set so as to overcome the pressing force of the spring 33 to open the inlet port 32 by this valve opening force based on the fluid pressure difference.

In this state, when a control signal is applied from an engine control unit 27 ("ECU" hereinafter) to the solenoid-controlled inlet valve 30, an electric current flow through the solenoid 30*b*, so that the electromagnetic plunger 30*c* moves rightward in FIG. 1 with a magnetic force, whereby a compressed state of the spring is maintained. As a result, the inlet valve head 31 maintains the inlet port 32 open state.

When the plunger 2 completes its suction stroke and shifts to its compression stroke (an upwardly moving state in FIG. 1) while voltage (a control signal) is applied to the solenoid-controlled inlet valve 30, the solenoid 30*b* maintains in its continuing energized state. Thereby the inlet valve head 31 remains the open state.

The volume of the pressurizing chamber 11 decreases with the compressing motion of the plunger 2, but in this state the internal pressure of the pressurizing chamber does not rise because the fuel having taken in the pressurizing chamber 11 is again returned to the inlet passage 10*d* (pre-inlet port 30*a*) through the inlet valve head 31 which is open. This stroke is called as "a fuel return stroke".

In this fuel return state, when the control signal provided from the ECU 27 is turned-off to de-energize the solenoid coil 30*b*, the magnetic force exerted to the plunger 30*c* becomes extinct after the lapse of a certain time (after a magnetic and mechanical delay time). Since the pressing force of the spring 33 exerts to the inlet valve head 31, so when the electromagnetic force exerting to the plunger 30*c* becomes extinct, the inlet valve head 31 closes the inlet port 32 under the pressing force of the spring 33. Upon closing of the inlet port 32, the fuel pressure in the pressurizing chamber 11 rises with the rising motion of the plunger 2. Then, when the fuel pressure becomes equal to or higher than the pressure of a fuel outlet port 12, the fuel remaining inside the pressurizing chamber 11 is discharged at a high pressure through an outlet valve device 8 and is fed to a common rail 23. This stroke is called as "a delivery stroke". That is, the compression stroke (a rising stroke from the bottom dead center to the top dead center) comprises the return stroke and the delivery stroke.

By controlling the timing of de-energizing the solenoid 30*c* in the solenoid-controlled inlet valve 30, it is possible to control the delivery amount of the high-pressure fuel. If the timing of de-energizing the solenoid 30*c* is advanced, then in the compression stroke, the ratio of the return stroke is small and that of the delivery stroke is large. That is, the amount of the fuel returned to the inlet passage 10*d* (pre-inlet port 30*a*) is small and that of the fuel discharged at a high pressure is large. In contrast to this, if the timing of de-energizing the solenoid 30*c* is delayed, then in the compression stroke, the ratio of the return stroke is large and that of the delivery stroke is small. That is, the amount of the fuel returned to the inlet passage 10*d* is large and that of the fuel discharged at a high pressure is small. The timing of de-energizing the solenoid 30*c* is controlled in accordance with an instruction provided from the ECU.

In the above arrangement, by controlling timing of de-energizing the solenoid 30*c*, the delivery amount of the high-pressure fuel can be controlled in accordance with the amount required by the internal combustion engine.

An outlet of the pressurizing chamber 11 is provided with the outlet valve device 8. The outlet valve device 8 includes an outlet valve seat 8*a*, an outlet valve 8*b* and an outlet valve spring 8*c*. When there is no fuel pressure difference between the pressurizing chamber 11 and the fuel outlet port 12, the outlet valve 8*b* is put in pressurized contact with the outlet valve seat 8*a* with the pressing force of the outlet valve spring 8*c* and is closed. Only when the internal fuel pressure of the pressurizing chamber 11 becomes higher than the pressure of the fuel outlet port 12, the outlet valve 8*b* opens against the outlet valve spring 8*c*. Thereby the fuel in the pressurizing chamber 11 is discharged at a high pressure to the common rail 23 through the fuel outlet port 12.

Thus, a required amount of the fuel in the fuel inlet port 10*a* is pressurized to a high pressure by the reciprocating motion of the plunger 2 within the pressurizing chamber 11 in the pump body 1 and the high-pressure fuel is fed to the common rail 23 from the fuel outlet port 12.

The common rail 23 is provided with the injectors 24 and a pressure sensor 26. The injectors 24 are prepared corresponding to the number of cylinders in the internal combustion chamber. The injectors 24 open and close in accordance with control signals provided from the ECU 27 to inject fuel into the cylinders.

The pump body 1 is provided with a relief passage 100A for communicating between the downstream side of the outlet valve 8*b* and the pressurizing chamber 11, while bypassing the outlet valve 8*b*.

In the relief passage 100A is provided with a relief valve 102 which allows the flow of fuel in only one direction from the outlet (delivery) passage to the pressurizing chamber 11. The relief valve 102 is pressurized to a relief valve seat 101 with a relief spring 104. A relief valve device 100 is configured so that the relief valve 102 leaves from the relief valve seat 101 and opens the relief passage 100A when the difference in pressure between the pressurizing chamber 11 and the relief passage 100A becomes equal to or higher than a predetermined pressure.

In the event of occurrence of an abnormally high pressure for example in the common rail 23 due to failure of an injector 24 and when the difference in pressure between the relief passage 100A and the pressurizing chamber 11 becomes equal to or higher than the valve opening pressure set in the relief valve 102, the relief valve 102 opens and the fuel which has thus become an abnormally high pressure is returned to the pressurizing chamber 11 through the relief passage 100A. Thereby pipes installed in high-pressure portions such as the common rail 23 are protected.

The arrangement and operation of the high-pressure fuel pump will be described below in more detail with reference to FIGS. 1 to 5.

The pressurizing chamber 11 is formed at central position of the pump body 1. Furthermore, the pump body 1 is provided with the solenoid-controlled inlet valve 30 for feeding the fuel to the pressurizing chamber 11 and the outlet valve device 8 for discharging the fuel from the pressurizing chamber 11 to the outlet (delivery) passage 12. Further, a cylinder 6 for guiding a reciprocating motion of the plunger 2 is installed so as to face the pressurizing chamber 11.

The outer periphery of the cylinder 6 is held by a cylinder holder 7. The cylinder 6 is installed in the pump body 1 by engaging a male thread formed on the outer periphery of the cylinder holder 7 into a female thread formed on the pump body 1. The plunger 2 is adapted to perform the reciprocating motion within the pressurizing chamber 11, and the cylinder 6 holds the plunger 2 slidably in the directions of the reciprocating motion.

A tappet 3 is provided at a lower end of the plunger 2, the tappet 3 converts a rotational motion of a cam 5 mounted on a cam shaft of the engine into a vertical reciprocating motion and transfers the vertical reciprocating motion to the plunger 2. With a spring 4, the plunger 2 is put in pressurized contact with the tappet 3 through a retainer 15, whereby the plunger 2 can be reciprocated vertically with the rotational motion of the cam 5.

A plunger seal 13 is held at a lower end side portion of the inner periphery of the cylinder holder 7 in a state in which it is in relatively slidable contact with the outer periphery of the plunger 2 at a lower end portion of the cylinder 6. With the plunger seal 13, a blow-by gap between the plunger 2 and the cylinder 6 is sealed to prevent the leakage of fuel to the exterior. At the same time, lubricating oil (including engine oil) for lubricating a sliding portion in the engine room is prevented from flowing into the pump body 1 through the blow-by gap.

Figure 3:
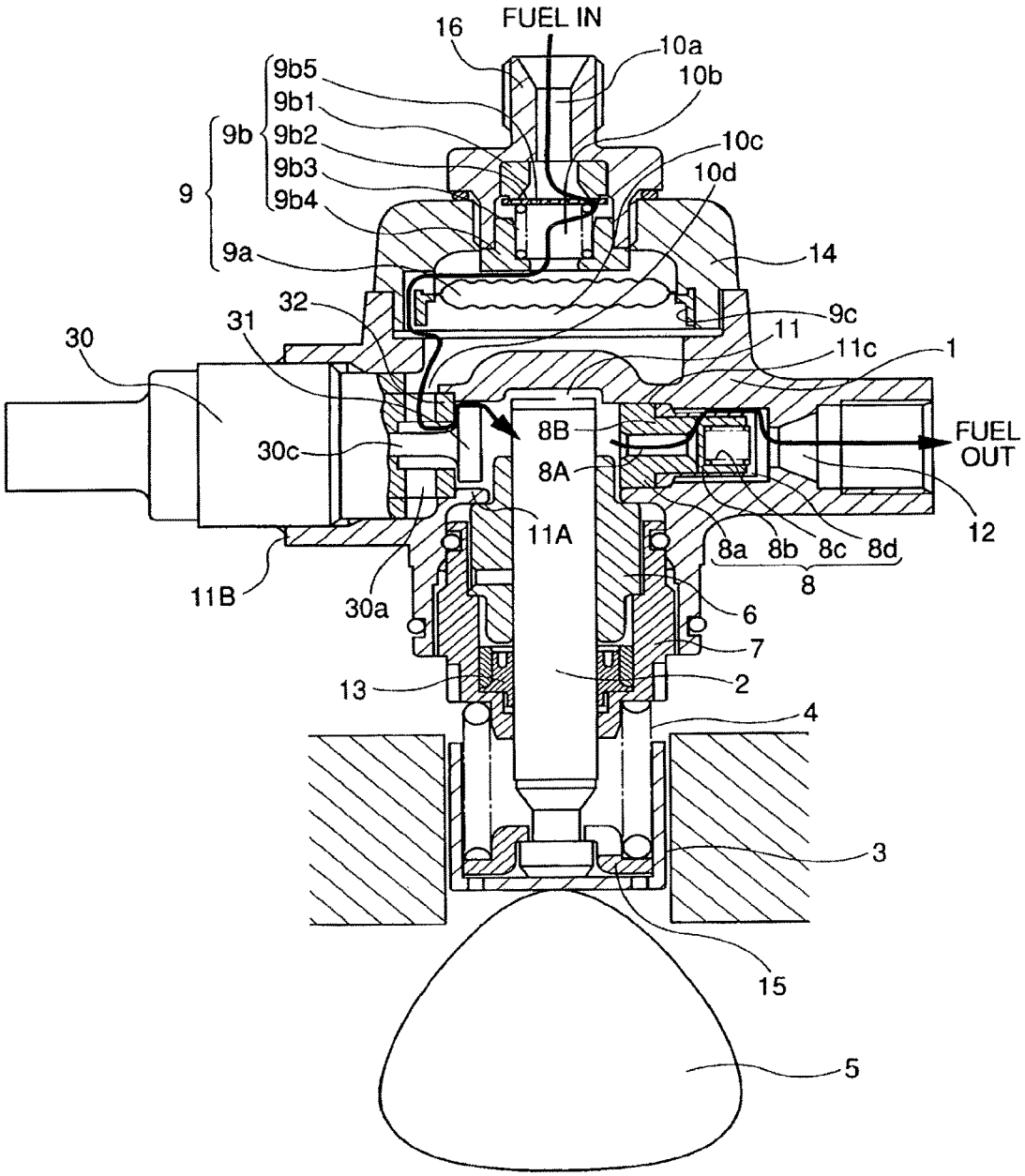
FIG. 3 is an entire longitudinal sectional view of the high-pressure fuel pump of the first embodiment.

As shown in FIG. 3, the pressure pulsation dumping device 9 for dumping the spread of pressure pulsation generated within the pump to the fuel pipe 28 is installed in a damper cover 14.

The pressure pulsation dumping device 9 comprises a pressure damper 9*a* and a cut-off mechanism 9*b*. The cut-off mechanism 9*b* is fixed to the damper cover 14 by means of an inlet joint 16 provided with an inlet port 10*a*. The damper cover 14 is fixed to the pump body 1 and the inlet passage 10 comprises 10*a*, 10*b*, 10*c* and 10*d*. The pressure pulsation dumping device 9 is provided at halfway of the inlet passage to diminish the spread of pressure pulsation generated within the pump to the fuel pipe 28.

In the case where the fuel once taken in the pressurizing chamber 11 is returned to the inlet passage 10*d* (pre-inlet port 30*a*) again through the opened inlet valve head 31 because of the capacity being controlled, pressure pulsation occurs in the inlet passage 10 (pre-inlet port 30*a*) by the fuel returned to the inlet passage 10. However, since the inlet passage 10*c* as a damper chamber (formed between the cup-like damper cover 14 and an annular depression formed in the outer periphery of the pump body 1) is provided with a metallic damper 9*a*, such a pressure pulsation is absorbed and diminished by expansion and contraction of the metallic damper 9*a*. The metallic damper 9*a* is formed by jointing two corrugated metallic discs at their outer peripheries, with an inert gas such as argon being charged into the interior of the metallic damper 9*a*. The numeral 9*c* denotes a metallic mounting piece for fixing the metallic damper 9*a* to the inner periphery of the damper cover 14.

The cut-off mechanism 9*b* is provided in the interior of the inlet joint 16. The outer periphery of a cut-off valve seat 9*b*1 of the cut-off mechanism 9*b* is press-fitted and thereby fixed to the inner periphery on the fuel inlet side of the inlet joint 16. One surface of a disc-like cut-off valve 9*b*2 of the cut-off mechanism 9*b* comes into contact with the cut-off valve seat 9*b*1 to cut off the fuel passage. One end of a helical valve spring 9*b*3 of the cut-off mechanism 9*b* is in contact with the other surface of the cut-off valve 9*b*2. The other end of the valve spring 9*b*3 of the cut-off mechanism is supported by a spring stopper 9*b*4. The spring stopper 9*b*4 is fixed to the inner periphery on the fuel inlet side of the inlet joint 16 by press-fitting.

Thus, the cut-off valve 9*b*2 is pressurized toward the cut-off valve seat 9*b*1 by the valve spring 3 so as to allow the flow of fuel to only the direction of 10*b*, 10*c* and 10*d* from the inlet port 10*a*. The cut-off valve 9*b*2 is provided with small holes 9*b*5.

In the fuel return stroke, the cut-off valve 9*b* is rendered in a closed state, so that the fuel merely flows in a very small amount from the inlet joint 10*a* to the inlet pipe 28 through the small holes 9*b*5 and is mostly absorbed by a change in volume of the pressure dumping damper 9*a*. The small holes 9*b*5 prevent an increase of fuel pressure in the inlet passages 10*b*, 10*c* and 10*d* (pre-inlet port 30*a*) during the fuel return stroke.

The solenoid-controlled inlet valve 30 is fitted on a cylindrical boss portion 11B of the pump body 1 in an airtight manner so that the inlet valve head 31 closes an inlet-side opening 11A of the pressurizing chamber 11, and is thereby fixed to the pump body.

When the solenoid-controlled inlet valve 30 is thus mounted to the pump body, the pre-inlet port 30*a* and the inlet passage 10*d* are connected with each other.

The outlet valve device 8 has an outlet valve body 8 which is centrally provided with an outlet (delivery) passage 8A. The outer periphery of the outlet valve body 8 is press-fitted in a cylindrical hole 11C formed on an outlet side of the pressurizing chamber 11. The outlet valve body 8B is provided with an outlet valve seat 8*a* and a cylindrical outlet valve 8*b* with a bottom. An outer flat surface of the bottom of the cylindrical outlet valve 8*b* is in contact with the outlet valve seat 8*a* by pressing force of the valve spring 8*c*. The valve spring 8*c* is constituted by a helical spring. The outlet valve 8*b* and the valve spring 8*c* are inserted in the cylindrical portion of the outlet valve body 8B and held on the outlet side of the outlet valve body 8B by an outlet valve stopper 8*d*. The cylindrical outlet valve stopper 8*d* is press-fitted in the outlet-side outer periphery of the outlet valve body 8B, thus eventually constituting the outlet valve device 8.

When mounting the outlet valve device 8, the outlet valve device 8 is press-fitted from the pressurizing chamber 11 side into the outlet hole 11C formed in the pressurizing chamber and is held by the cylindrical hole 11C.

The outlet valve stopper 8*d* has an annular portion as a spring holder for the valve spring 8*c* and plural leg portions extending toward the outlet valve body 8B from the annular portion. The tips of the leg portions are connected together through a ring-like portion.

When the outlet valve 8*b* in the outlet valve unit 8 opens by overcoming the pressing force of the valve spring 8*c*, it comes into contact with the outlet valve stopper 8*d* and the operation thereof is restricted thereby.

Thus, the stroke of the outlet valve 8*b* is determined appropriately by the outlet valve stopper 8*d*.

If the stroke is too large, the fuel discharged at a high pressure to the fuel outlet port 12 again flows backward into the pressurizing chamber 11, so that the efficiency as a high-pressure pump becomes lower. The outer periphery portion of the outlet valve 8*b* is guided by the outlet valve stopper 8*d* so that the outlet valve 8*b* moves in only the stroke direction when the outlet valve 8*b* repeats opening and closing motions.

According to the above construction, the outlet valve device 8 serves as a check valve which restricts the fuel flowing direction.

Further, the operation of the relief valve device will be described below in detail.

Figure 2:
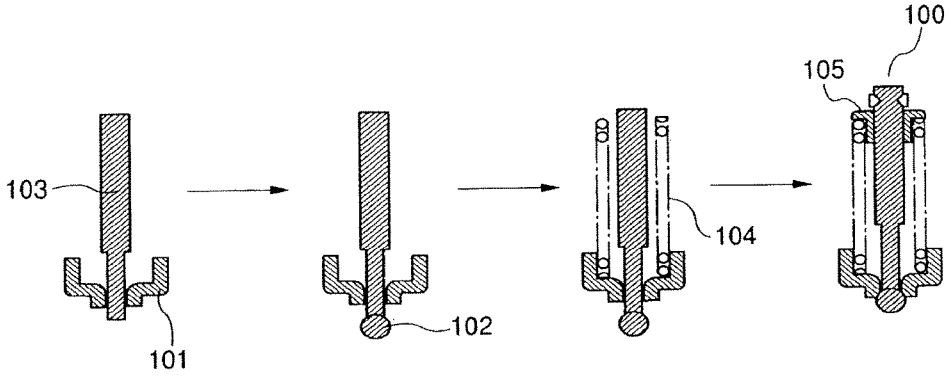
FIG. 2 is an assembling diagram for explaining a unit of a relief valve device used in the first embodiment.

As assembly processes of the relief valve shown in FIG. 2, the relief valve device 100 comprises a relief valve seat-spring holder 101, a relief valve 102, a relief valve rod 103, a relief spring 104 and a relief spring stopper 105.

When doing assembly of the relief valve device, the valve rod 103 is inserted into the relief valve seat-spring holder 101 and thereafter one end of the valve rod 103 is provided with the relief valve 102 by welding for example. Then, the relief spring 104 is inserted around the valve rod 103 and one end of the relief spring 104 is inserted into the relief valve seat-spring holder 101. Then relief spring stopper 105 is fitted on the valve rod 103 and fixed thereon by welding for example. A spring force of the relief valve spring 104 for pressing the relief valve 102 against the valve seat 101 is determined by the fixed position of the relief spring stopper 105. An opening pressure of the relief valve 102 is determined to a prescribed value based on the pressing force of the relief spring 104.

Figure 1:
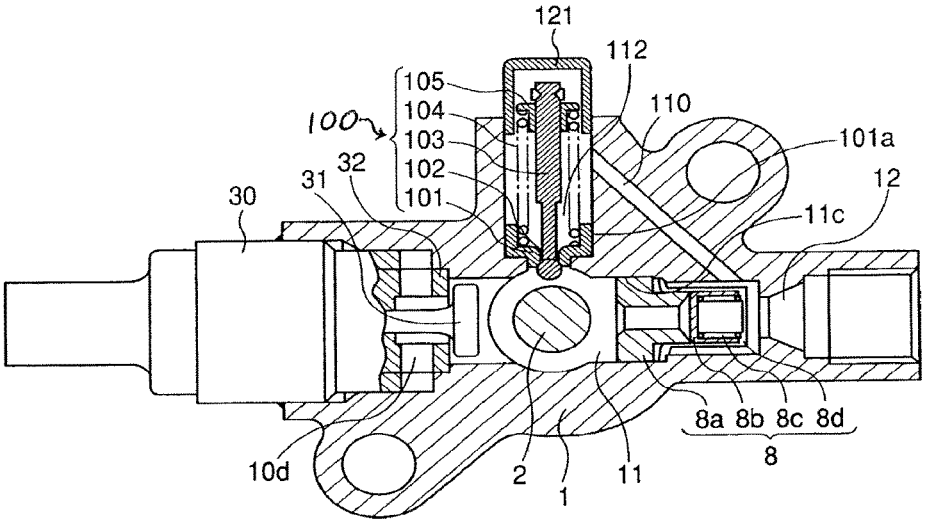
FIG. 1 is an entire cross sectional view of a high-pressure fuel pump according to a first embodiment of the present invention.

As shown in FIG. 1, the relief valve device 100 thus unitized is press-fitted at a press-fit portion 101*a* along the inner periphery wall of a through hole 109 formed in the pump body and is fixed thereby. Then, a cap 121 is fixed so as to close an inlet of the through hole 109 to prevent the leakage of fuel from the high-pressure fuel pump to the exterior. A relief chamber 112 is formed by the relief valve seat-spring holder 101, through hole 109 and cap 121.

The relief chamber 112 communicates to the fuel outlet port 12 of the high-pressure fuel pump. Thus the relief spring 104 is installed on the outside (the relief chamber 112) of the pressurizing chamber 11 with reference to the relief valve seat 101. In other words, since the relief chamber 112 is provided on the outlet side of the high-pressure pump with reference to the relief valve seat 101, the relief spring 104 is installed on the outlet side of the high-pressure pump with reference to the relief valve seat 101. Accordingly the volume of the pressurizing chamber 11 does not increase even if the relief valve seat 101 (the outlet) of the relief valve device 100 faces the pressurizing chamber 11 of the high-pressure fuel pump.

Figure 5:
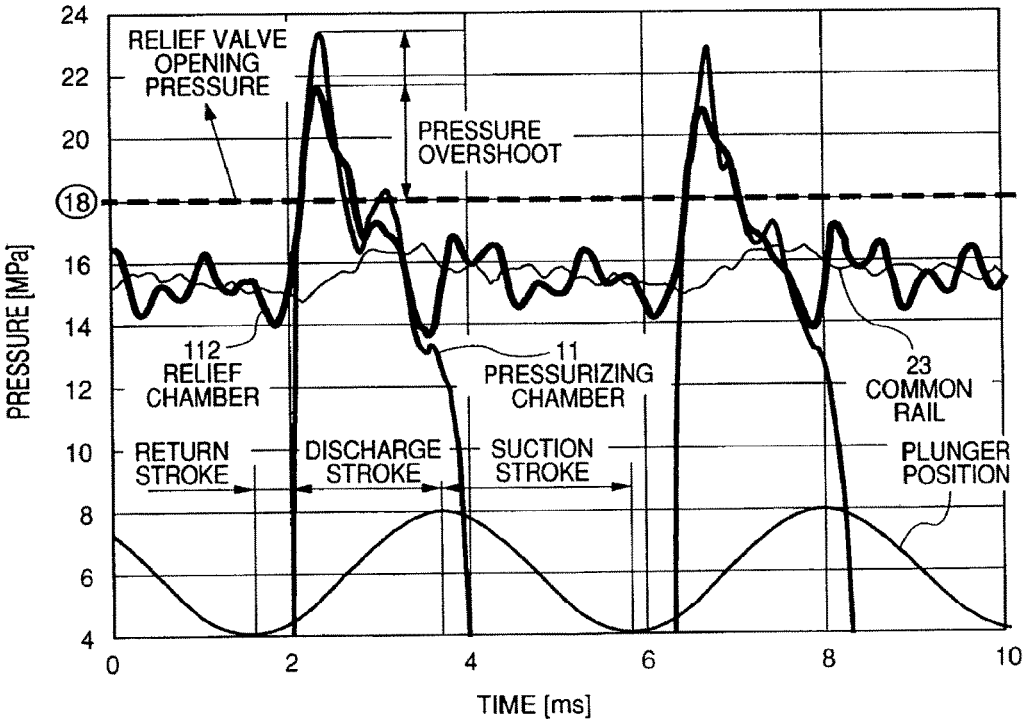
FIG. 5 shows pressure waveforms in various portions of the high-pressure fuel pump of the first embodiment and in a common rail.

FIG. 5 shows an example of pressure waveforms in various portions in a state in which, with the high-pressure fuel pump, the fuel is normally pressurized to a high pressure and the high-pressure fuel is fed to the common rail 23. A target fuel pressure in the common rail is adjusted to 15 MPa. The pressure for opening the relief valve 102 is adjusted to 18 MPa.

During an upward-moving motion of the plunger 2 and just after the pump operation changes from the fuel return stroke to the pressurizing stroke, a pressure overshoot occurs within the pressurizing chamber 11. The pressure overshoot in the pressurizing chamber 11 is propagated from the fuel outlet port 12 and the relief chamber 112 through a relief passage 110. As a result, the propagated pressure equal to or higher than the pressure for opening the relief valve 102 occurs on the inlet side of the relief valve 102. However, the pressure overshoot in the pressurizing chamber 11 also exerts the relief valve 102 from the pressurizing chamber 14 side toward the valve seat 101 because the relief valve 102 is positioned in the pressurizing chamber 11 outside the outlet of the relief chamber 112. The pressure overshoot in the pressurizing chamber 11 is larger than that in the relief chamber 112. Consequently, a difference force of both pressure overshoots exerts in a direction of closing the relief valve 102 and hence it is possible to prevent the relief valve 102 from erroneously opening even if the pressure overshoot occurs at the change from the fuel return stroke to the pressurizing stroke.

Thus, even if the high-pressure fuel pump is provided the relief valve device 100 to prevent the occurrence of a damage caused by an abnormal high-pressure in a high-pressure portion such as the common rail 23, it is possible to attain a high-pressure fuel pump which exhibits neither a lowering of flow rate caused by malfunction nor a lowering of volumetric efficiency.

Next, a detailed description will be given below about the case where an abnormal high-pressure occurs for example in the common rail 23 due to failure or the like of an injector 24.

As the volume of the pressurizing chamber 11 decreases with the plunger 2 upward-motion, the internal pressure of the pressurizing chamber increases. When the internal pressure of the pressurizing chamber 11 becomes higher than that of the outlet passage 12, the outlet valve 8*b* opens and the fuel is discharged from the pressurizing chamber 11 to the outlet passage 12. From the instant just after the outlet valve 8*b* opens, the internal pressure of the pressurizing chamber overshoots and becomes very high. This high pressure is also propagated into the outlet passage 12 and the internal pressure of the outlet passage also overshoots at the same timing as the pressurizing chamber.

In this case, if the outlet of the relief valve device 100 communicates to the inlet passage, the difference in pressure between the inlet and the outlet of the relief valve becomes higher than the pressure for opening the relief valve, resulting in malfunction of the relief valve.

On the other hand, in this embodiment, the outlet of the relief valve device 100 communicates to the pressurizing chamber 11 (the relief valve seat 101 faces to the pressurizing chamber 11) and the relief valve 102 is positioned in the pressurizing chamber 11. The internal pressure of the pressurizing chamber 11 consequently exerts the relief valve 102 on the outlet side of the relief valve device and the internal pressure of the outlet passage 12 also exerts the relief valve 102 on the inlet side of the relief valve. Since pressure overshoot is occurring at the same timing within both the interior of the pressurizing chamber 11 and that of the outlet passage 12, the difference in pressure between the inlet and outlet of the relief valve device 100 does not become higher than the pressure for opening the relief valve. That is, the relief valve does not malfunction.

As the volume of the pressurizing chamber increases with the plunger 2 downward-motion, the internal pressure of the pressurizing chamber decreases. When the internal pressure of the pressurizing chamber 11 becomes lower than that of the inlet passage 10*d*, the fuel flows into the pressurizing chamber 11 through the inlet passage 10*d*. Then, as the volume of the pressurizing chamber 11 again decreases with the plunger 2 upward-motion, the fuel is pressurized to a high pressure and is discharged in this state by the mechanism described above.

If a fuel injection valve fails, that is, the injection function stops, and the fuel fed to the common rail cannot be supplied to the associated cylinder, the fuel accumulates between the outlet valve 8*b* and the common rail 23, and the fuel pressure becomes abnormally high.

In this case, if the pressure increase is a gentle increase, the abnormal condition is detected by a pressure sensor in the common rail, and a safety function of a capacity control mechanism (the solenoid-controlled inlet valve 30) in the inlet passage is carried out so as to decrease the amount of fuel discharged. However, an instantaneous abnormal increase of pressure cannot be coped with by this feedback control using the pressure sensor.

In the event the capacity control mechanism in the inlet passage or an overflow passage should fail and fail to function in the maximum capacity mode, the outlet pressure of high-pressure pump becomes abnormally high in a state of operation for which a large amount of fuel is not required.

In this case, even if the pressure sensor in the common rail detects the abnormally high pressure, it is impossible to remedy this abnormally high pressure condition because the capacity control mechanism itself is at fault.

When such an abnormally high pressure occurs, the relief valve device 100 used in this embodiment functions as a safety valve.

In this case, as the volume of the pressurizing chamber 11 increases with the plunger 2 downward-motion, the internal pressure of the pressurizing chamber decreases. When the pressure in the inlet of the relief valve, i.e., the pressure in the outlet passage 12 of the pump, becomes higher than the pressure in the outlet of the relief valve, i.e., the internal pressure of the pressurizing chamber 11, the relief valve 102 opens and allows the abnormally high pressure fuel in the outlet passage 12 to return into the pressurizing chamber 11. Therefore, the fuel pressure does not rise beyond a prescribed high level even when an abnormally high pressure occurs, that is, the high pressure pipes are protected.

During the normal delivery stroke in this first embodiment, because of the mechanism described above, even when the pressure overshoot occurs, an inlet-outlet pressure difference equal to or higher than the pressure for opening the relief valve 102 is not developed and hence the relief valve does not open.

In both of suction stroke and fuel return stroke, the fuel pressure in the pressurizing chamber 11 lowers to a low level equal to that in the suction pipe 28. On the other hand, the pressure in the relief chamber 112 rises to the same level as in the common rail 23. When the difference in pressure between the relief chamber 112 and the pressurizing chamber becomes equal to or higher than the pressure for opening the relief valve 102, the relief valve 102 opens. Thereby the fuel whose pressure has become abnormally high is returned from the relief chamber 112 to the pressurizing chamber 11, whereby the high pressure pipes, including the common rail 23, are protected.

The high-pressure fuel pump is required to pressurize the fuel to a very high pressure of several MPa to several ten MPa, and the pressure (valve opening pressure) for opening the relief valve must be higher. If the valve opening pressure is set lower than such a high pressure, the relief valve will open even when the fuel is pressurized normally by the high-pressure fuel pump. Such a malfunction of the relief valve causes a decrease of the delivery (discharge) volume as the high-pressure fuel pump and a lowering of the energy efficiency.

Therefore, for setting the opening pressure of the relief valve at such a very high pressure it is necessary to increase the pressing force of the relief spring, thus inevitably calling for an increase in size of the relief spring.

However, in the case where the relief spring is disposed in the pressurizing chamber or in the relief passage located on the pressurizing chamber side, such an increase in size of the relief valve leads to a so much increase in the internal volume of the pressurizing chamber or in a chamber leading to the pressurizing chamber.

The high-pressure fuel pump decreases the internal volume of the pressurizing chamber with the plunger upward-motion, thereby compressing and pressurizing the fuel and discharging the fuel at a high pressure. Therefore, the more increase in volume of the pressurizing chamber, the larger amount of fuel is pressurized to a high pressure, thus resulting in a lowering of compressibility in the high-pressure fuel pump and hence a lowering of energy efficiency.

Further, with the lowering of energy efficiency, the fuel in an amount required by the internal combustion engine can no longer be pressurized to a high pressure. On the other hand, in this embodiment, the relief passage 100A provides communication between the downstream side of the outlet passage 12 relative to the outlet valve 8*b* and the pressurizing chamber 11. Furthermore, the fuel pump is provided with the relief passage 100A separately from the outlet passage 12 and the relief valve 102 for allowing the fuel to flow in only one direction from the outlet passage 12 to the pressurizing chamber 11. In addition, the relief valve 102 is provided in the relief passage so as to open when the difference in pressure between the valve inlet and outlet becomes equal to or higher than a predetermined valve opening pressure. The relief valve device 100 comprises the relief valve 102, the relief valve seat member 101 for the relief valve, the relief spring 104 for producing the pressing force, and the spring force transfer member (for example the valve rod 103) for transferring the spring force to the relief valve 102 so that the relief valve 102 is pressed toward the valve seat 101. The relief spring is installed on the outlet side (relief chamber 112) of the high-pressure pump with reference to the relief valve seat member 101.

According to the above arrangement, the relief spring can be positioned outside the pressurizing chamber and the outlet (relief valve seat portion) of the relief valve device can be positioned at the pressurizing chamber without increasing the volume of the pressurizing chamber.

Thus, it is possible to attain a high-pressure fuel pump without malfunction of the relief valve and without a lowering of compressibility (a lowering of energy efficiency) as the high-pressure fuel pump.

A detailed description will be given below about the lowering of compressibility (lowering of energy efficiency) on the basis of a change in volumetric efficiency taking the bulk modulus of fuel into account. Various values are set as in the following table.

| | | | |
|---|---|---|---|
| Bulk modulus | K | 1 | GPa (=$10^9$ N/mm$^2$ (newton per square millimeter |
| Internal volume of the pressurizing chamber | V | 1700 | mm$^3$ (cubic millimeter) |
| Plunger dia. ϕ | D | 10 | mm (millimeter) |
| Cam lift | L | 5 | Mm (millimeter) |
| Pressure of pressurized fuel | P | 10 | MPa ($10^6$ N/mm$^2$ (newton per square millimeter |
| Theoretical discharge capacity | Q = π * D^2/4 * L | 392.7 | mm$^3$/stroke (cubic millimeter per stroke) |
| Volume strain | dV/V = P/K | 0.0100 | dimensionless |
| Discharge volume taking bulk | Q' = Q-dV | 375.7 | mm$^3$/stroke (cubic millimeter per |

-continued

| | | | |
|---|---|---|---|
| modulus into account | | | stroke) |
| Volumetric efficiency taking bulk modulus into account | E = Q'/Q | 0.957 | dimensionless |

In this case, the volumetric efficiency is 0.957.

Assuming that the volume of the pressurizing chamber increases to, for example, 6700 $m^3$ (cubic millimeter) as a result of installation of the relief valve device, the volumetric efficiency decreases to 0.828 (a lowering of 0.148) according to the above calculation.

The smaller the cam lift, the larger the volumetric efficiency is decreased.

The cam lift in the above table is 5 mm (millimeter), but if it is changed to 3 mm (millimeter) and calculation is made, a change of volumetric efficiency in case of a change in the internal volume of the pressurizing chamber being made from 1700 $mm^3$ (cubic millimeter) to 6700 $mm^3$ (cubic millimeter) is as follows:

In case of 3 mm (millimeter) lift: 0.928→0.758
(a lowering of 0.170)
In case of 5 mm (millimeter) lift: 0.957→0.828
(a lowering of 0.148)

Thus, the lowering of volumetric efficiency is remarkable in the case of a pump of a small cam lift.

If a high fuel delivery (discharge) pressure is required, the volumetric efficiency so much decreases, with a consequent lowering of compressibility (a lowering of energy efficiency).

There may be adopted a construction wherein there are provided two relief passages for communication between the downstream side of the outlet passage relative to the outlet valve and the upstream side of the inlet passage relative to the inlet valve. In this case, relief valves which allow the flow of fuel in only one direction from the outlet passage to the pressurizing chamber are disposed in the relief passages respectively so as to open when the inlet-outlet pressure difference becomes equal to or higher than a predetermined valve opening pressure. In this case, the operating pressures, i.e., opening pressures, of the two relief valves may be set to different values.

According to such a construction, in the event of failure of one mechanism, the other mechanism operates as a backup mechanism.

Incidentally the plural relief passages may comprise a first relief passage whose outlet is open at the pump-inlet passage to be a low fuel pressure passage and a second relief passage whose outlet is open at the pressurizing chamber of the pump to be a high fuel pressure side. Furthermore, an operating pressure (that is a difference pressure between the outlet passage pressure and the inlet passage pressure) for operating the relief valve device of the first relief passage may be set so as to be higher than an operating pressure (that is a difference pressure between the outlet pressure and the pressurizing chamber) of the second relief passage.

Second Embodiment

A second embodiment of the present invention will be described below with reference to FIGS. 6 and 7.

Figure 6:
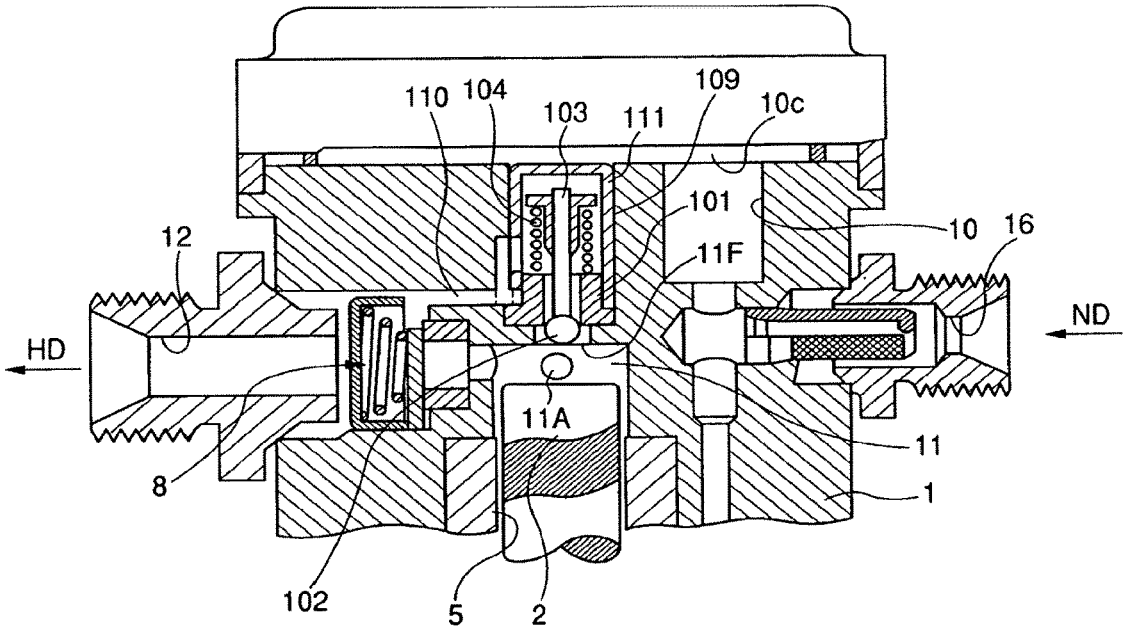
FIG. 6 is an entire cross sectional view of a high-pressure fuel pump according to a second embodiment of the present invention.
Figure 7:
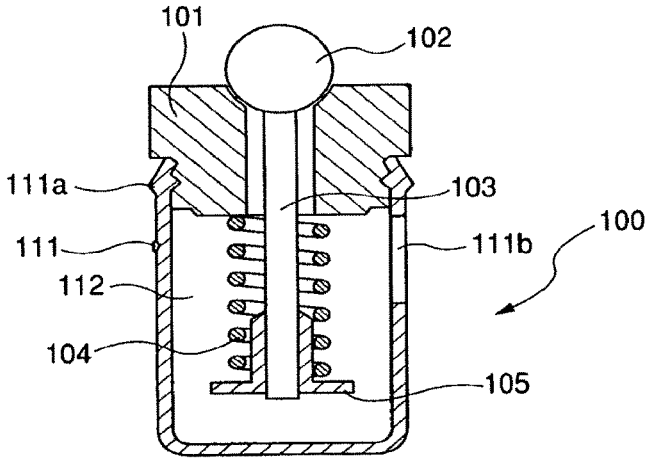
FIG. 7 is a diagram for explaining a unit of a relief valve device used in the second embodiment.

In the example shown in FIG. 6, a unitized relief valve device 100 is mounted on top of the pressurizing chamber 11. In this example, a holder 111 for the relief valve device is fixed integrally to a relief valve seat 101 by welding 111*a*. The holder 111 is provided with an aperture 111*b* for communicating to a relief passage 110. Other members identified by the same reference numerals as in the first embodiment represent the same functional members as in the first embodiment.

In this embodiment, an aperture 11F is formed in the top of the pressurizing chamber 11. The aperture 11F is closed with the relief valve seat 101 and the relief valve 102. Only the relief valve 102 among all members of the relief valve device is disposed on the pressurizing chamber 11-side. When the relief valve 102 opens, the relief chamber 112 and the aperture 11F communicate to each other through an orifice formed centrally of the relief valve seat 101. The resulting relief passage communicates to the pressurizing chamber 11.

In this embodiment, moreover, since the relief valve device 100 is inserted and fixed into a mounting hole 109 which opens to an inlet passage 10C, even if there should occur fuel leakage from between the holder 111 and the inner periphery surface of the mounting hole, the fuel does not leak to the exterior and thus safety is ensured.

Third Embodiment

A third embodiment of the present invention will be described below with reference to FIG. 8.

Figure 8:
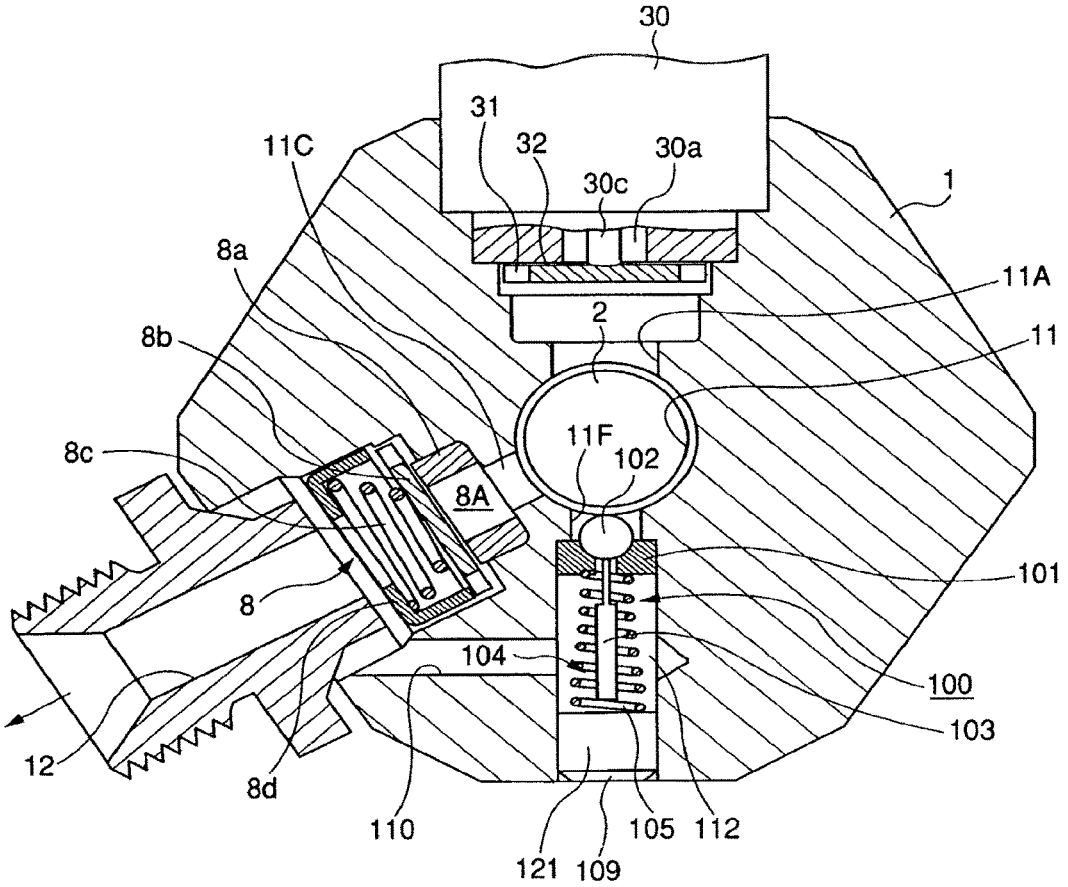
FIG. 8 is an entire cross sectional view of a high-pressure fuel pump according to a third embodiment of the present invention.

In the embodiment illustrated in FIG. 8 the fuel outlet port 12 and the relief passage 110 are disposed in a triangular form and this point is the same as in the embodiment illustrated in FIG. 1.

In the embodiment illustrated in FIG. 1, because of the type wherein the outlet valve device 8 is mounted from the pressurizing chamber side, the inlet-side hole 11A and the outlet-side hole 11C in the pressurizing chamber are disposed on the same axis.

In such a type as the embodiment illustrated in FIG. 8 wherein the outlet valve device 8 is mounted into the outlet-side hole 11C from the outside of the pump body 1, it is possible to construct the pump so that the solenoid-controlled inlet valve 30 and the relief valve device 100 are disposed on the same axis.

Fourth Embodiment

A fourth embodiment of the present invention will be described below with reference to FIG. 9.

Figure 9:
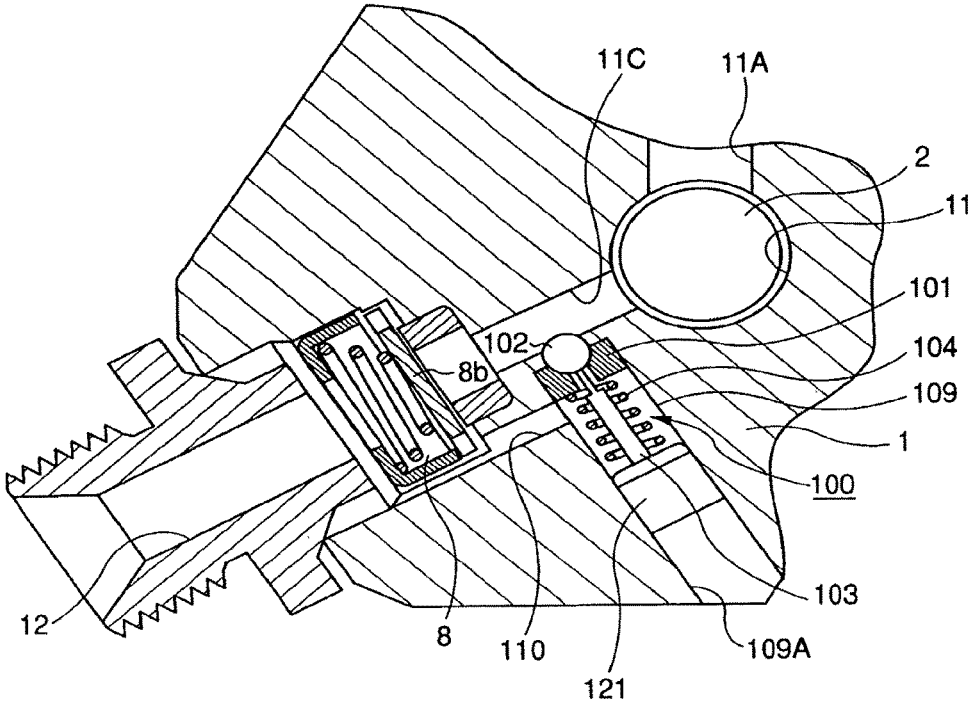
FIG. 9 is an entire cross sectional view of a high-pressure fuel pump according to a fourth embodiment of the present invention.

In the embodiment illustrated in FIG. 9, a through hole 109 for mounting of the relief valve device 100 is formed so as to communicate with the outlet passage 11C located between the pressurizing chamber 11 and the outlet valve device 8.

This embodiment is advantageous in that the outlet valve 8*b* in the outlet valve device 8 and the relief valve 102 in the relief valve device 100 can be disposed in proximity to each other and hence the relief passage 110 can be made shorter than in the other embodiments.

According to the fuel pump of those embodiments thus constructed, they are possible to provide high-pressure fuel pumps having the following advantages. That is, in the event of occurrence of an abnormally high pressure due to for example failure of a fuel injection valve, fuel pressurized to the abnormally high pressure can be released from the relief valve to the pressurizing chamber. Thus, pipes and other devices of the high-pressure pumps are not damaged by the abnormally high pressure. Furthermore, high-pressure pumps which are superior in compressibility, i.e., high in energy efficiency, can be provided while ensuring the above-mentioned advantages Although the present invention has been described above while making reference as an example to a high-pressure fuel pump in a gasoline engine, the present invention is also applicable to a high-pressure fuel pump in a diesel engine.

Further, the present invention is applicable to a high-pressure fuel pump provided with any type of a capacity control mechanism independently of the type and mounting position of the capacity control mechanism.

What is claimed is:

1. A high-pressure fuel pump comprising:

a pressurizing chamber which is formed in a pump body;

an outlet valve device which is disposed on an outlet passage side of the pressurizing chamber;

a relief valve device which is disposed in a relief passage fluidly connecting an outlet passage to the pressurizing chamber, while bypassing the outlet valve device, wherein the relief valve device includes a relief valve, a relief valve seat, and a relief spring configured to pull the relief valve toward the relief valve seat, the relief valve device in the relief passage is fixed so as to close an aperture connecting to the pressurizing chamber, and the relief spring is disposed outside of the pressurizing chamber, wherein the pump body defines a cavity into which the relief valve is inserted, the cavity having a first longitudinal end and a second longitudinal end that is opposite to the first longitudinal end, the second longitudinal end is located at an outermost surface of the pump body, and the relief valve opens along a direction that is away from the second longitudinal end of the cavity.

2. The high-pressure fuel pump according to claim 1, wherein the valve seat has a seat surface formed on a pressurizing chamber side.

3. The high-pressure fuel pump according to claim 2, wherein the valve seat has a spring receiving surface formed on an opposite side from the seat surface.

4. The high-pressure fuel pump according to claim 1, wherein the relief valve is formed in a spherical-surface shape.

5. The high-pressure fuel pump according to claim 1, further comprising:

an inlet valve device which is disposed on an inlet passage side of the pressurizing chamber; wherein the inlet valve device includes an inlet valve, an inlet valve seat, and a spring configured to urge the inlet valve via a plunger, and the spring is disposed on an opposite side of the inlet valve seat from the pressurizing chamber.

6. The high-pressure fuel pump according to claim 1, wherein the relief valve device forms an independent unit as an assembly.

7. The high-pressure fuel pump according to claim 6, wherein the relief valve device is inserted into a through hole extending from a side wall of the pump body.

8. The high-pressure fuel pump according to claim 1, further comprising:

a pressure damper configured to reduce pressure pulsation; and a cut-off valve configured to allow fuel to flow only in a direction toward the pressurizing chamber from an inlet joint, wherein the cut-off valve is disposed on an upstream side of the pressure damper.

9. The high-pressure fuel pump according to claim 8, wherein the cut-off valve is provided with a hole.

10. The high-pressure fuel pump according to claim 1, wherein the relief valve device further includes a relief valve rod connected to the relief valve, and the relief spring is configured to pull the relief valve toward the relief valve seat by pressing the relief valve rod in a direction away from the relief valve seat.

11. The high-pressure fuel pump according to claim 1, wherein the aperture is formed on a peripheral side face of the pressurizing chamber.

12. The high-pressure fuel pump according to claim 1, wherein the aperture is formed on a top of the pressurizing chamber.

13. The high-pressure fuel pump according to claim 1, wherein an inner peripheral surface of the relief passage forms the aperture.

14. A high-pressure fuel pump comprising:

a pressurizing chamber which is formed in a pump body;

an outlet valve device which is disposed on an outlet passage side of the pressurizing chamber;

a relief valve device which is disposed in a relief passage fluidly connecting an outlet passage to the pressurizing chamber, while bypassing the outlet valve device, wherein the relief valve device includes a relief valve and a relief valve seat against which the relief valve abuts, the pressurizing chamber includes a top wall forming the top of the pressurizing chamber, the top wall including a bottom surface facing the pressurizing chamber and an opposing top surface facing away from the pressurizing chamber, wherein the relief valve seat is disposed within a recess formed in the top surface, the pump body defines a cavity into which the relief valve is inserted, the cavity having a first longitudinal end and a second longitudinal end that is opposite to the first longitudinal end, the second longitudinal end is located at an outermost surface of the pump body, and the relief valve opens along a direction that is away from the second longitudinal end of the cavity.

15. A high-pressure fuel pump comprising:

a pressurizing chamber which is formed in a pump body;

an outlet valve device which is disposed on an outlet passage side of the pressurizing chamber;

a relief valve device which is disposed in a relief passage fluidly connecting an outlet passage to the pressurizing chamber, while bypassing the outlet valve device, wherein the relief valve device includes a relief valve, a relief valve seat, and a relief spring configured to pull the relief valve toward the relief valve seat, the relief valve device includes a holder welded to the relief valve seat, the holder containing the relief spring therein, the holder is fixed within a mounting hole formed in the pump body, the mounting hole opening directly to an inlet passage of the pump, the relief valve being disposed in the mounting hole, the mounting hole having a first longitudinal end and a second longitudinal end that is opposite to the first longitudinal end, the second longitudinal end is located at an outermost surface of the pump body, and the relief valve opens along a direction that is away from the second longitudinal end of the cavity.

* * * * *